US008156580B1

(12) United States Patent
Paone

(10) Patent No.: US 8,156,580 B1
(45) Date of Patent: Apr. 17, 2012

(54) SINK WITH CUTOUT

(76) Inventor: Arthur J. Paone, Belmar, NJ (US)

( * ) Notice: Subject to any disclaimer, the term of this patent is extended or adjusted under 35 U.S.C. 154(b) by 1 day.

(21) Appl. No.: 13/030,568

(22) Filed: Feb. 18, 2011

(51) Int. Cl.
*E03C 1/244* (2006.01)

(52) U.S. Cl. ..... 4/654; 4/619

(58) Field of Classification Search ..... 4/584, 612–614, 4/619, 654
See application file for complete search history.

(56) References Cited

U.S. PATENT DOCUMENTS

| | | | | |
|---|---|---|---|---|
| 832,320 | A * | 10/1906 | James | 4/651 |
| 980,880 | A | 1/1911 | Mueller | |
| 1,202,222 | A | 10/1916 | Quinn | |
| 3,010,474 | A | 11/1961 | Moen | |
| 3,427,049 | A | 2/1969 | Politz | |
| 3,790,966 | A | 2/1974 | Keane | |
| 4,186,761 | A | 2/1980 | Guarnieri | |
| 4,281,857 | A | 8/1981 | Randall | |
| 4,852,192 | A | 8/1989 | Viegener | |
| 5,010,922 | A | 4/1991 | Agresta | |
| 5,050,246 | A | 9/1991 | Huntoon | |
| 5,232,008 | A | 8/1993 | Jeffress | |
| 5,375,272 | A | 12/1994 | Mikol | |
| 5,388,287 | A | 2/1995 | Tischler | |
| 5,465,749 | A | 11/1995 | Sauter | |
| 5,515,882 | A | 5/1996 | Hennis | |
| 5,535,776 | A | 7/1996 | Kingman | |
| 5,946,746 | A | 9/1999 | Bloom | |
| 6,209,153 | B1 | 4/2001 | Segien | |
| 6,220,278 | B1 | 4/2001 | Sauter | |
| 6,256,805 | B1 * | 7/2001 | Ludlow et al. | 4/541.1 |
| 6,385,798 | B1 | 5/2002 | Burns | |
| 6,631,730 | B1 | 10/2003 | Bloom | |
| 6,792,629 | B2 | 9/2004 | Nelson | |
| 7,003,818 | B2 | 2/2006 | McNerney | |
| 7,039,966 | B1 | 5/2006 | Cranston | |
| 7,174,581 | B2 | 2/2007 | McNerney | |
| 2004/0216225 | A1 * | 11/2004 | Booth et al. | 4/541.1 |
| 2005/0251907 | A1 | 11/2005 | Mintz | |
| 2006/0049633 | A1 | 3/2006 | McBride | |
| 2006/0200904 | A1 | 9/2006 | Vogel | |

* cited by examiner

*Primary Examiner* — Gregory Huson
*Assistant Examiner* — Janie Christiansen

(57) ABSTRACT

A sink, basin, tub or shower fixture with a cutout of such sink, basin, tub or shower located at a point on the fixture behind which the fittings and connections for the faucets and other attachments that are attached to the fixture can be found. This cutout is normally occupied by a removable segment of the fixture and joined to the fixture in a watertight manner. Thus anyone examining or replacing the faucets or attachments will readily be able to reach the nuts and bolts securing the faucets to the fixture and not have to work from under the fixture or within the confines of an enclosing cabinet.

3 Claims, 10 Drawing Sheets

SINK WITH CUTOUT

BACKGROUND OF THE INVENTION

1. Prior Art

The following is a tabulation of some prior art that presently appears relevant:

| | | | | |
|---|---|---|---|---|
| 980,880 | — | January 1911 | Mueller | — |
| 1,202,222 | — | October 1916 | Quinn | — |
| 3,010,474 | — | November 1961 | Moen | 137/359 |
| 3,427,049 | — | February 1969 | Politz | 285/46 |
| 3,790,966 | — | February 1974 | Keane | 4/192 |
| 4,186,761 | — | February 1980 | Guarnieri | 137/315 |
| 4,281,857 | — | August 1981 | Randall | 285/34 |
| 4,852,192 | — | August 1989 | Viegener | 4/191 |
| 5,010,922 | — | April 1991 | Agresta | 137/359 |
| 5,050,246 | — | September 1991 | Huntoon | 4/192 |
| 5,232,008 | — | August 1993 | Jeffress (Moen Inc.) | 137/15 |
| 5,375,272 | — | December 1994 | Mikol (Moen Inc.) | 4/695 |
| 5,388,287 | — | February 1995 | Tischler (Ecowater) | 4/678 |
| 5,465,749 | — | November 1995 | Sauter (Sterling Plumbing) | 137/359 |
| 5,515,882 | — | May 1996 | Hennis | 137/315 |
| 5,535,776 | — | July 1996 | Kingman (Moen Inc.) | 137/359 |
| 5,946,746 | — | September 1999 | Bloom (Emhart) | 4/675 |
| 6,209,153 | B1 | April 2001 | Segien, Jr. (Emhart) | 4/695 |
| 6,220,278 | B1 | April 2001 | Sauter (Kohler) | 137/315.12 |
| 6,385,798 | B1 | May 2002 | Burns (Moen Inc.) | 4/675 |
| 6,631,730 | B1 | October 2003 | Bloom (Emhart) | 137/359 |
| 6,792,629 | B2 | September 2004 | Nelson (Masco) | 4/695 |
| 2005/0251907 | A1 | November 2005 | Mintz | 4/695 |
| 7,003,818 | B2 | February 2006 | McNerney (Masco) | 4/695 |
| 2006/0049633 | A1 | March 2006 | McBride | 285/390 |
| 7,039,966 | B1 | May 2006 | Cranston | 4/695 |
| 2006/0200904 | A1 | September 2006 | Vogel | 4/695 |
| 7,174,581 | B2 | February 2007 | McNerney (Masco) | 4/695 |

2. Discussion of Prior Art

At least from 1911 (Mueller, 980,880), the difficulty of reaching nuts and bolts when repairing or replacing attachments (such as faucets, spray hoses and the like) on already installed sinks, tubs or showers has been recognized.

Sinks are commonly affixed to cabinet counters and a sink's attachments, including faucet assemblies and spray hoses, are secured to the sink's rear flange with mounting nuts from below the sink/counter.

In addition, the coupling nuts (usually compression nuts) connecting the water supply hoses to the tailpieces of the faucets are themselves under the sink in close proximity to the mounting nuts.

If the connections for the faucets or other attachments have to be examined to determine the source of a leak or if the attachments need to be replaced, the installer must get at those nuts from under the sink. This is the problem.

To remove, or even to examine, such nuts and bolts the installer, after removing all the household cleaners and other items usually stored under the sink, must lie on his/her back in the small enclosure of the cabinet and look up into the narrow and dark space between the sink and the wall where the nuts and bolts are located. If the faucets have to be removed the installer must work in this narrow space which does not allow for manipulation of an ordinary wrench in order to loosen or tighten the nuts and bolts. Special, though still inefficient, tools, such as basin wrenches, must be used to unlock the nuts, which may even have been corroded and frozen over time. Similarly, the installer must endure the same process when installing replacements faucets.

Each of the potentially relevant patents cited above as prior art recognized this problem and described it in various ways (see, for example, Mueller, 980,880; Politz, 3, 427,049; Keane, 3,790,966; Guarnieri, 4,186,761; Randall, 4,281,857; Viegener, 4,852,192 and Mikol, 5,375,272).

While all of the prior art dealt with solving the problem described above, none has suggested construction of sinks with a detachable section such as my solution proposes. Each prior attempt primarily focuses on a variation of faucet configuration in order to be able to mount the faucets and related attachments from above the sink/counter (for example: Sauter, 6,220,278: "Top Mounting Faucet Assembly;" Keane, 3,790,966: "Quick-Change Faucet;" Bloom, 6,631,730: "Quick Install Faucet Body"), except that the Cranston faucet assembly solution (7,039,966) would in addition require a serious modification to the sink's rim or flange as well (a cutting at the rear flange of the sink which would eliminate all the pre-drilled faucet/attachment openings). The term "top mounted" in this regard is to be distinguished from use of the same term to refer to the location of the water mixing manifold, now commonly housed in the faucet assembly above the sink, (see, for example, Krippendorf, 4,848,395).

These prior attempts to solve the problem described above have failed to do so, notwithstanding the long and broadly recognized nature of the problem. The related manufacturing industry is aware of the problem as indicated by the fact that major sink and faucet manufacturers have been assigned one or more of the cited patents which attempted to solve the problem (for example, Moen: Jeffess, 5,232,008; Mikol, 5375,272 and Kingman, 5,535,776; Kohler: Sauter, 6,220, 278).

Whether these solutions were too complicated, too expensive, not reliable or for some other reason, the fact is that today one cannot readily find a "top mounted" faucet assembly as described in the prior art or anything like it. On a recent inspection, for example, at a Lowe's store (Brick, N.J.) the Applicant did not find ONE faucet among the approximately 100 faucet displays that could be mounted from above the sink. Similarly, a review of Home Depot's website also fails to reveal any such "top mounted" faucets. Both "do it yourselfers" as well as plumbers (people skilled in the art), therefore, are still in the same position as described by Mueller in 1911.

BRIEF SUMMARY OF THE INVENTION

In accordance with one embodiment a sink with a detachable watertight section which is located at a point level with the nuts, bolts and connections which are behind the sink thereby facilitating easy access to them. Such easy access would allow for quick and convenient examination of the connections as well as for the ordinary manipulation of tools from a comfortable position for the installer to effectuate repair or replacement of faucets and similar attachments if replacement is required.

Advantage to Applicant's Solution

The advantages of Applicant's solution are that it is inexpensive, simple and universal—every sink can be manufactured as an Open Sesame™ sink, and any faucet or related attachment now in the marketplace could much more conveniently be attached to, or removed from, the sink.

Hereafter, with an Open Sesame™ sink, when a homeowner finds water under his/her sink, it will no longer necessitate removing all the bottles, rags and whatever else is stored under the sink; then getting a flashlight, crawling under the sink, turning over on one's back and then looking up at a series of supply tubes, each dripping with water, and trying to figure out whether the leak was caused by a loose connection of one of the supply tubes or otherwise. There will be no need to call a plumber immediately to figure out this mystery which may turn out, once detected, to be a failure that can inexpensively be remedied by the homeowner. The homeowner will just open the separable section or plate and look at all the connections and fittings. Then after determining where the leak is coming from, the homeowner or plumber, if one is preferred to do the work, can readily repair or replace the faucet or spray hose connection if that were the problem, using ordinary tools and with the installer in a comfortable position.

Other advantages will become apparent to both a person skilled in the art as well as to a "do it yourselfer" in a review of the description and drawings set forth herein. Similarly, while the above discussion focuses on sinks, it is intended for purposes of illustration only, since various changes and modifications within the spirit and scope of the solution I present will become apparent to those skilled in the art from the detailed description below and the drawings, including its application to any article of manufacture where fittings are located behind said article's body, such as basins, tubs and showers.

BRIEF DESCRIPTION OF THE DRAWINGS

In the drawings, closely related figures have the same number but different alphabetic suffixes.

DETAILED DESCRIPTION OF THE INVENTION

Figure 1:
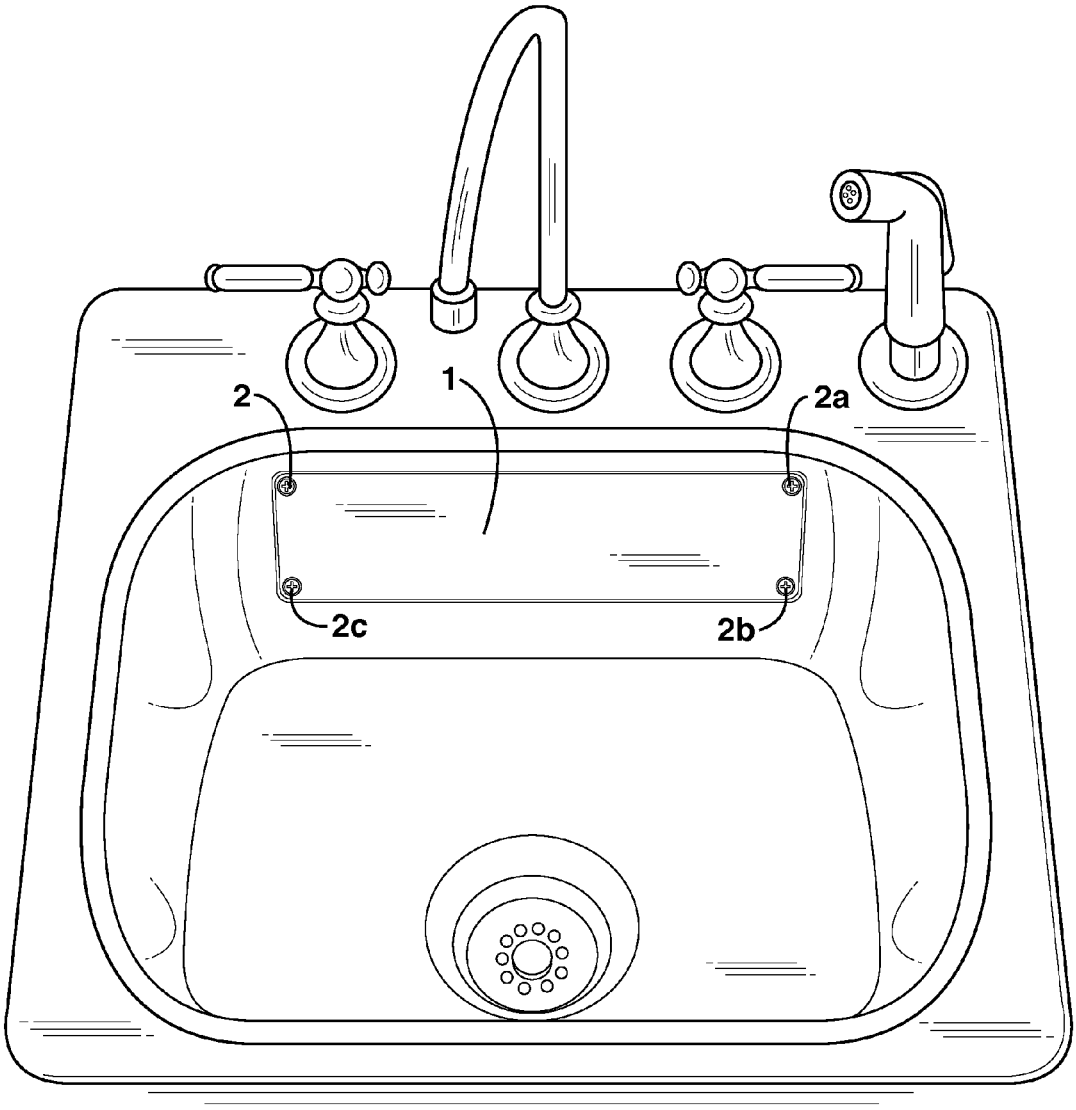
FIG. 1 is one embodiment and shows a standard sink with a detachable segment or section secured by four screws.
Figure 2:
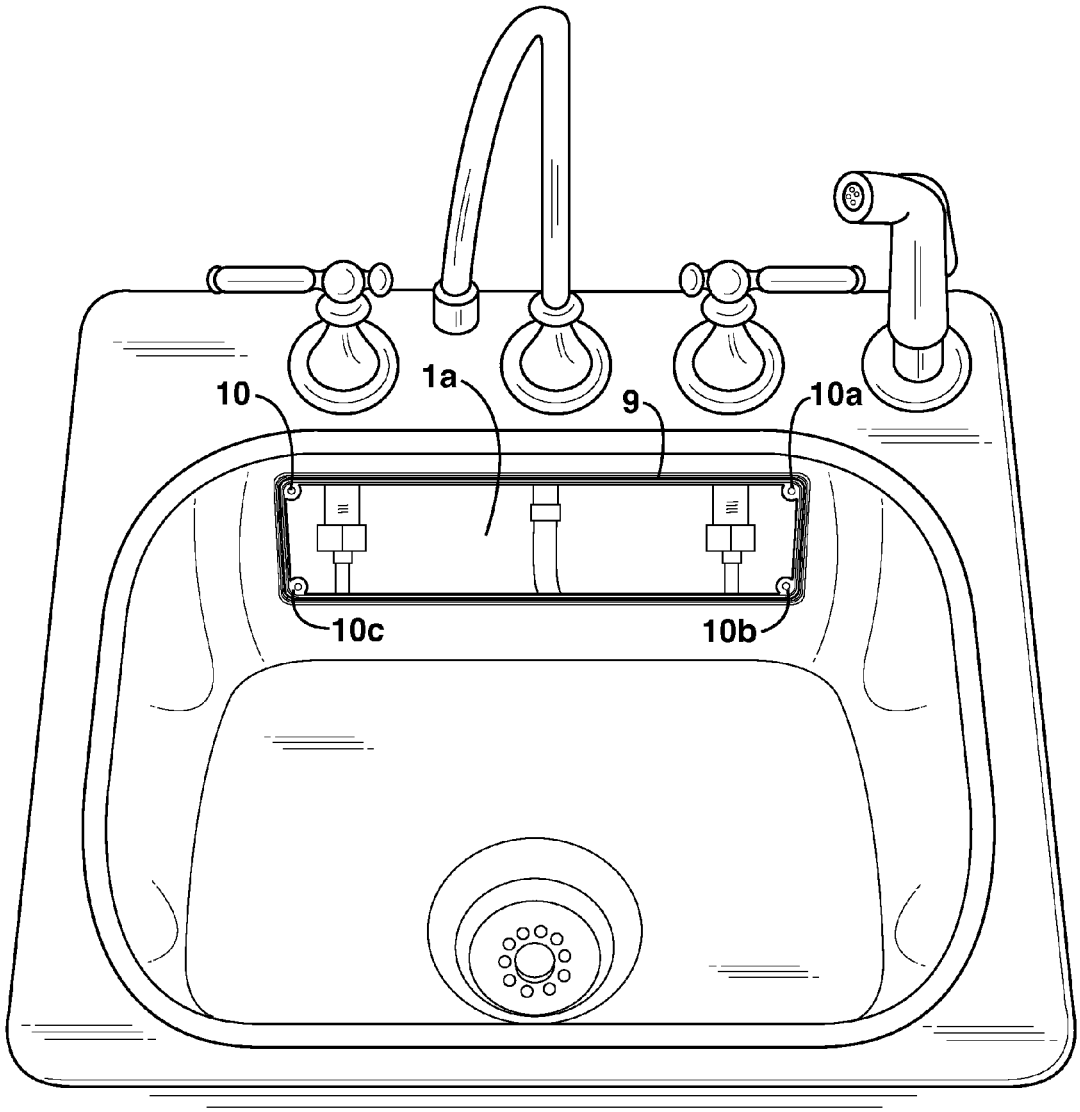
FIG. 2 shows that sink with a hole where the detachable section has been removed.
Figure 3:
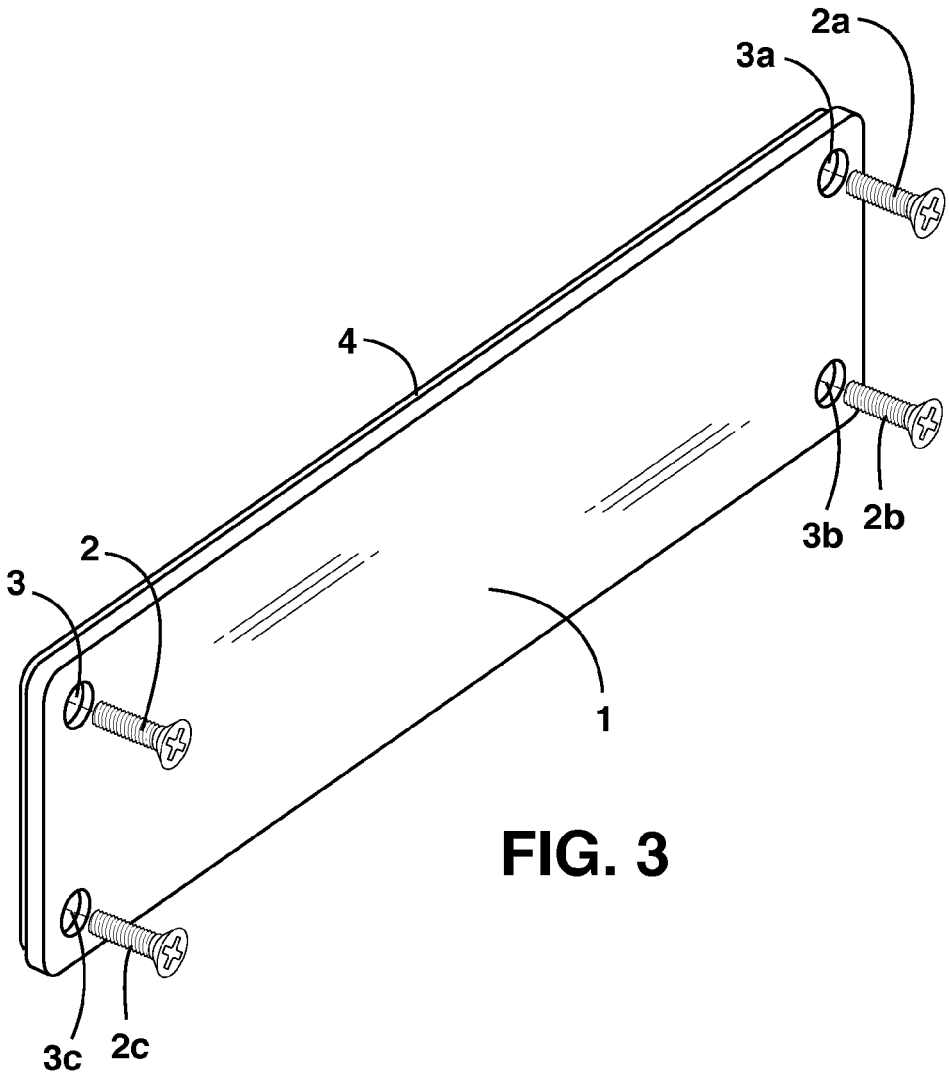
FIG. 3 show the front of the detachable section with screw openings and screws and FIG. 3*a* shows an enlarged screw and washer.
Figure 3A:
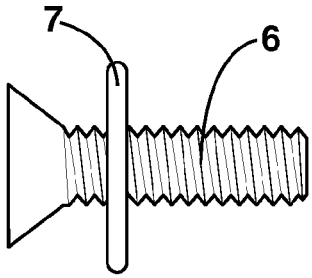
Figure 4:
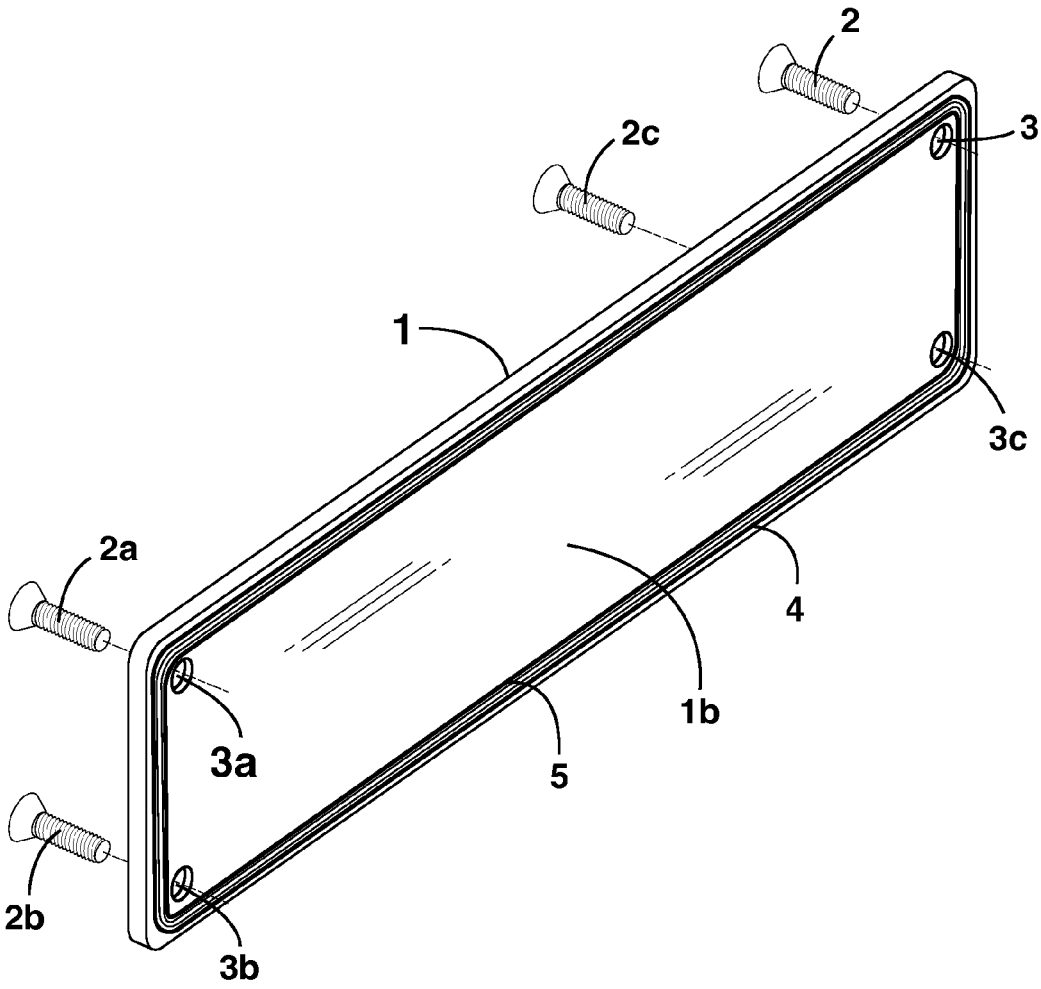
FIG. 4 shows the reverse side of the detachable section with its ring of double protruded rubber washers around the edge of the section and also openings for the screws.
Figure 5:
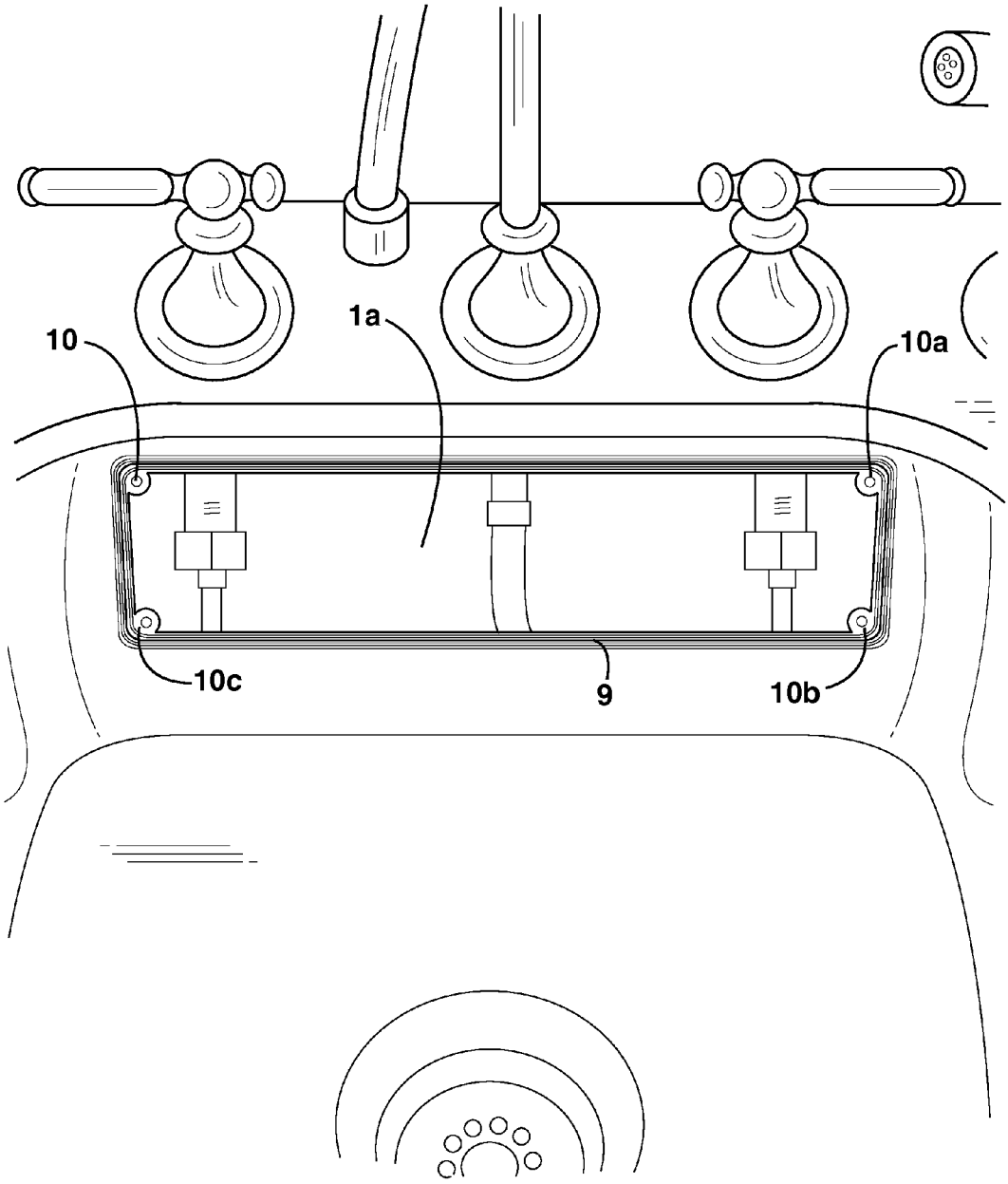
FIG. 5 is an enlarged drawing of the hole as shown in FIG. 2.

One embodiment is as illustrated in FIGS. 1, 2, 3, 3*a*, 4 and 5. FIG. 1 is a typical sink with faucets and spray hose and shows a removable segment or section 1 secured to the sink with four screws 2, 2*a*, 2*b*, and 2*c*. FIG. 2 shows the hole in the sink 1*a* where the detachable segment has been removed and indicating a recessed indentation around the hole on the sink body with a protruded rubber washer ring 9 around the perimeter of the recessed perimeter and four threaded receptacles for the screws 10, 10*a*, 10*b* and 10*c*. FIG. 3 is the front of the detachable sink segment 1 showing said screws 2, 2*a*, 2*b* and 2*c* and the corresponding openings in the segment for the screws, 3, 3*a*, 3*b* and 3*c*. FIG. 3*a* shows an enlarged view of one of the screws 6 with a washer 7. FIG. 4 shows the reverse of that removable segment 1*b* in this embodiment with a double protruded rubber washer 4 and 5 along the perimeter and with a groove between the washers where the washer on the sink body as shown in FIG. 2 would fit. FIG. 5 is an enlarged view of the sink hole 1*a* as shown in FIG. 2.

Figure 6:
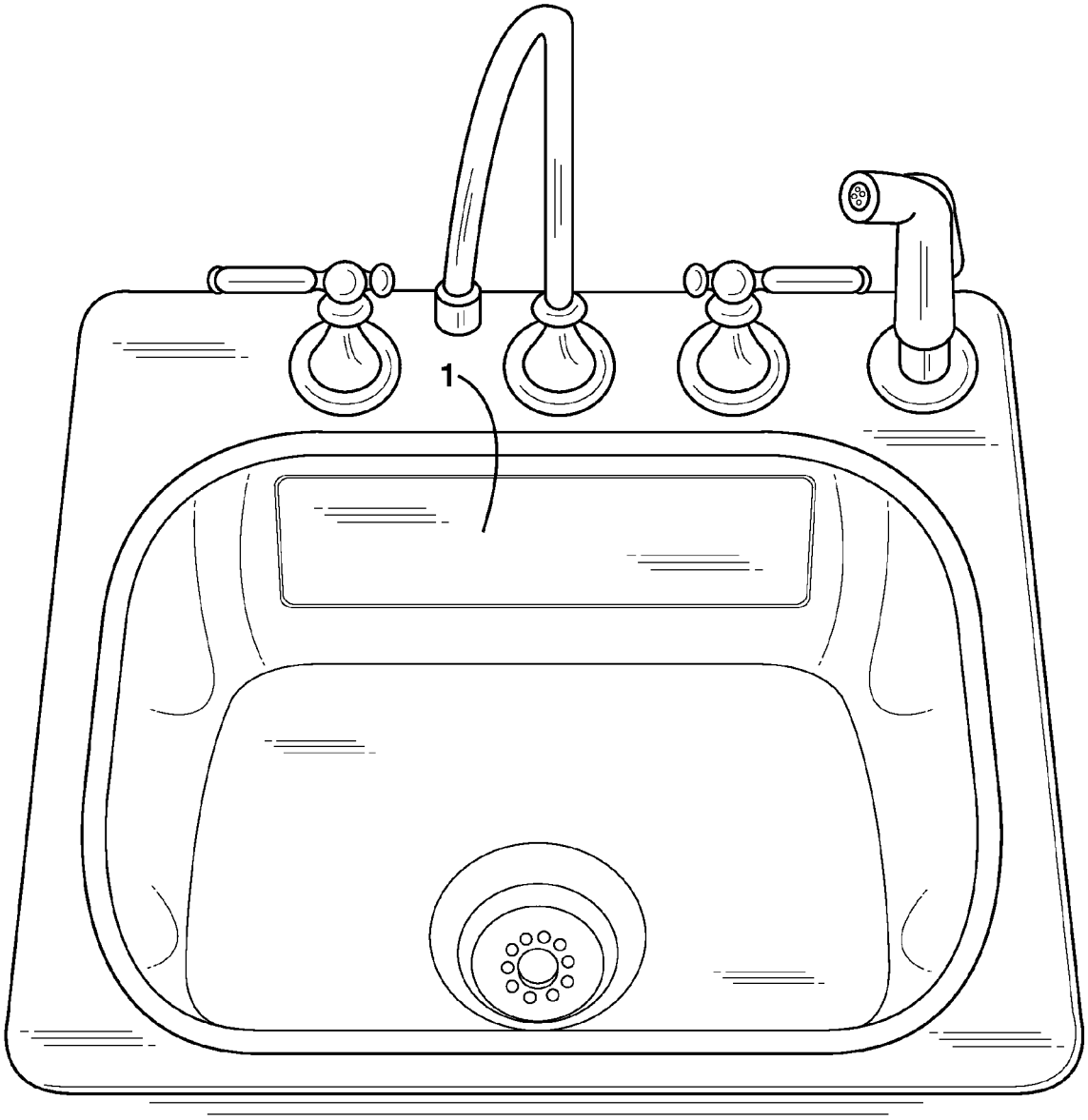
FIG. 6 is another embodiment and shows a standard sink with a detachable section.
Figure 7:
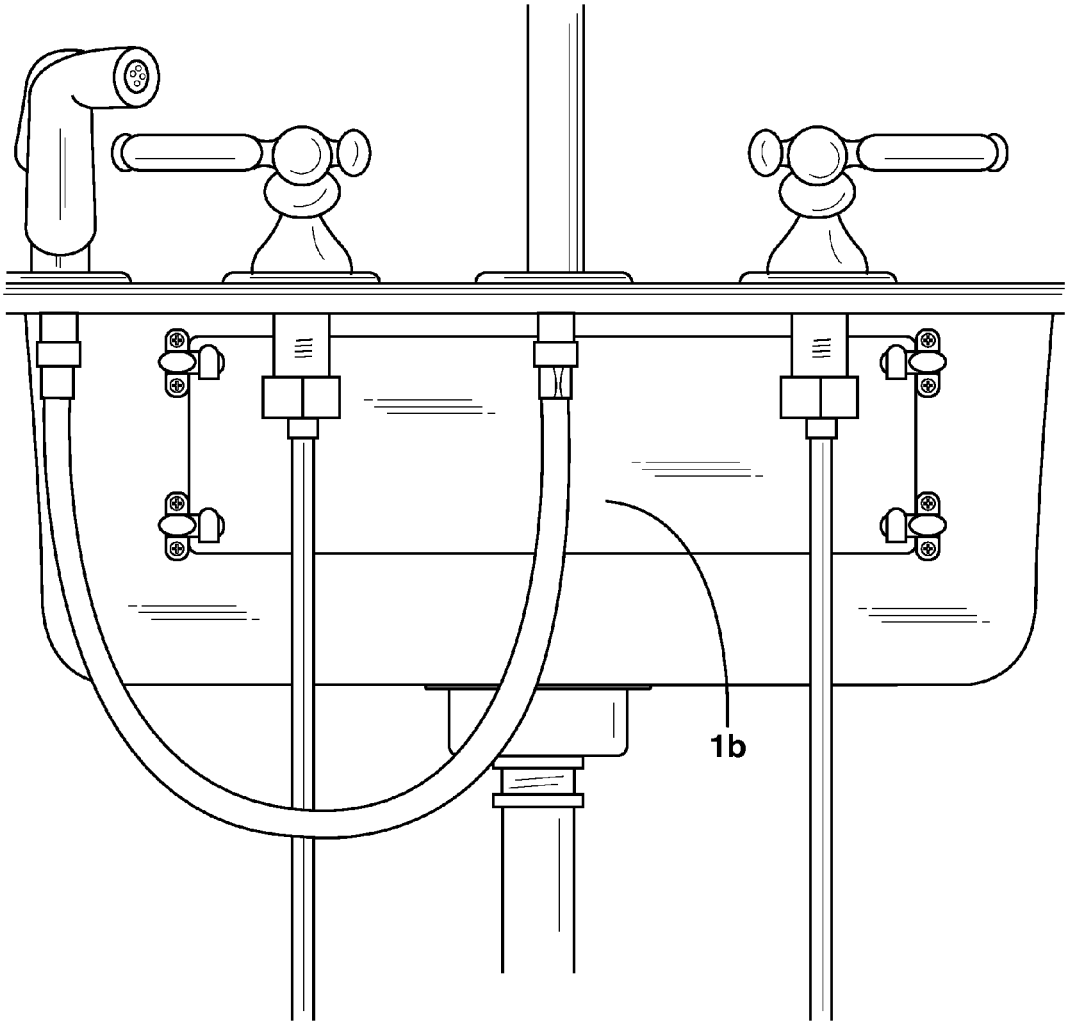
FIG. 7 shows the back of that sink with one variation of latches securing the detachable section to the sink.
Figure 8:
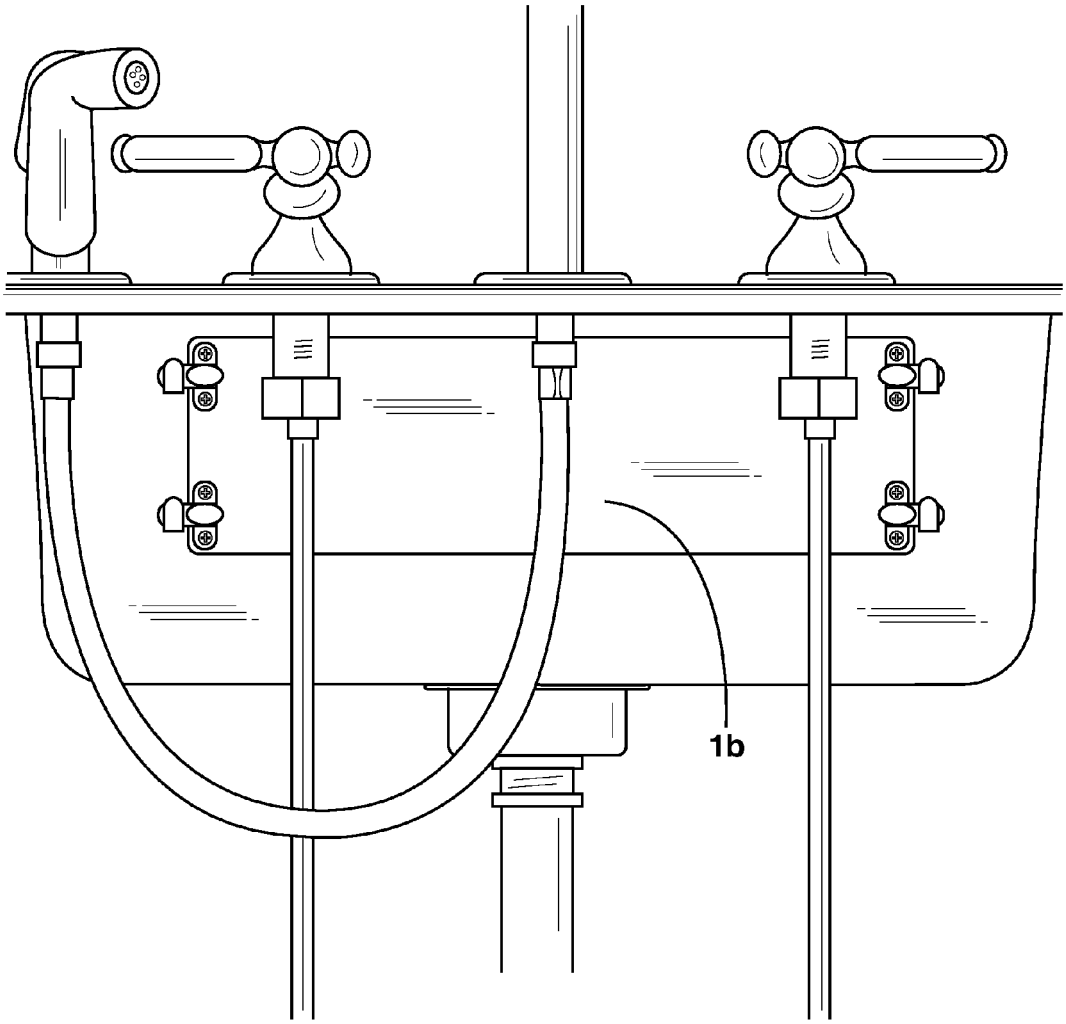
FIG. 8 shows the back of that sink but with a second variation of latches securing the detachable section to the sink.
Figure 9:
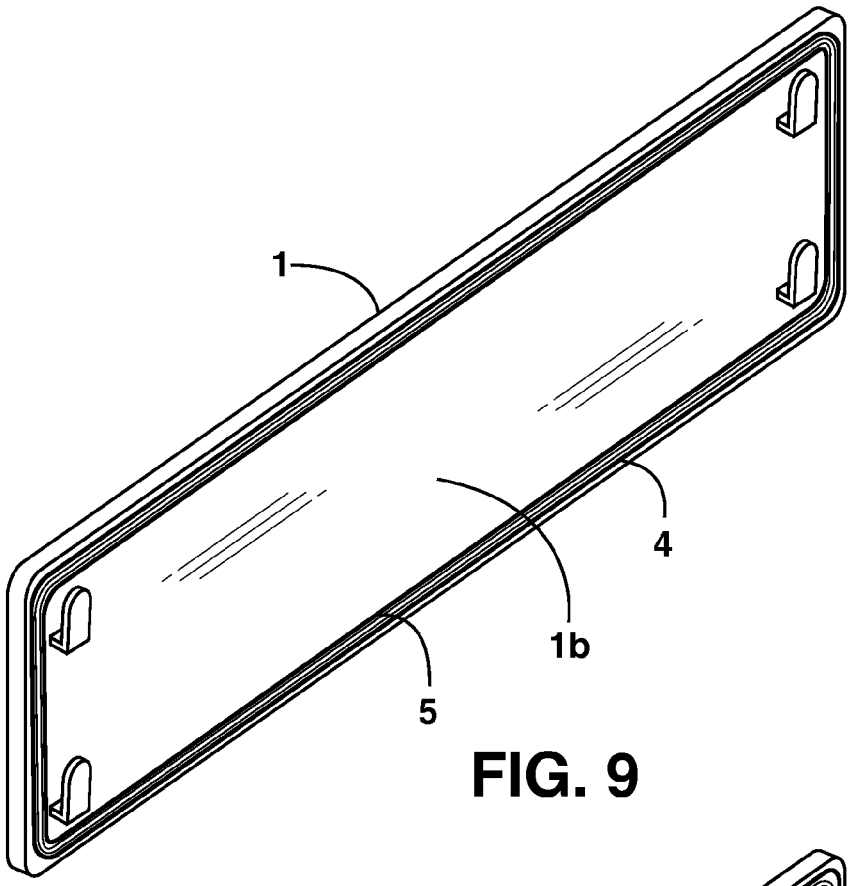
FIGS. 9 and 9*a* show the reverse side of the detachable section with the two variations of latch location corresponding to embodiments shown in FIGS. 7 and 8.
Figure 9A:
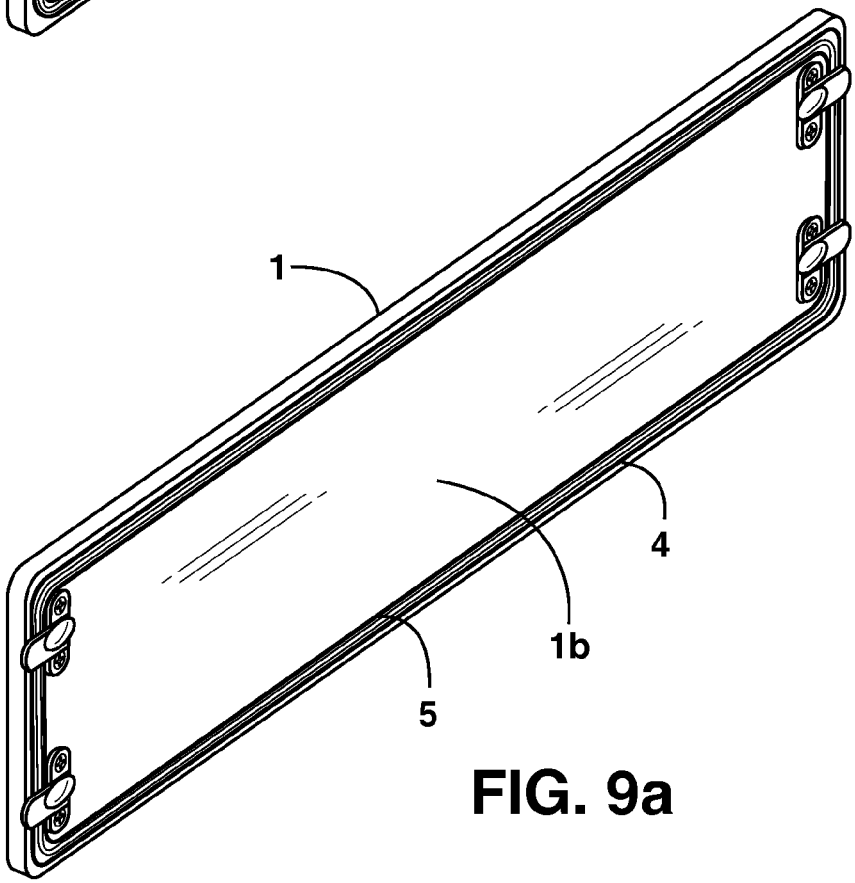
Figure 10:
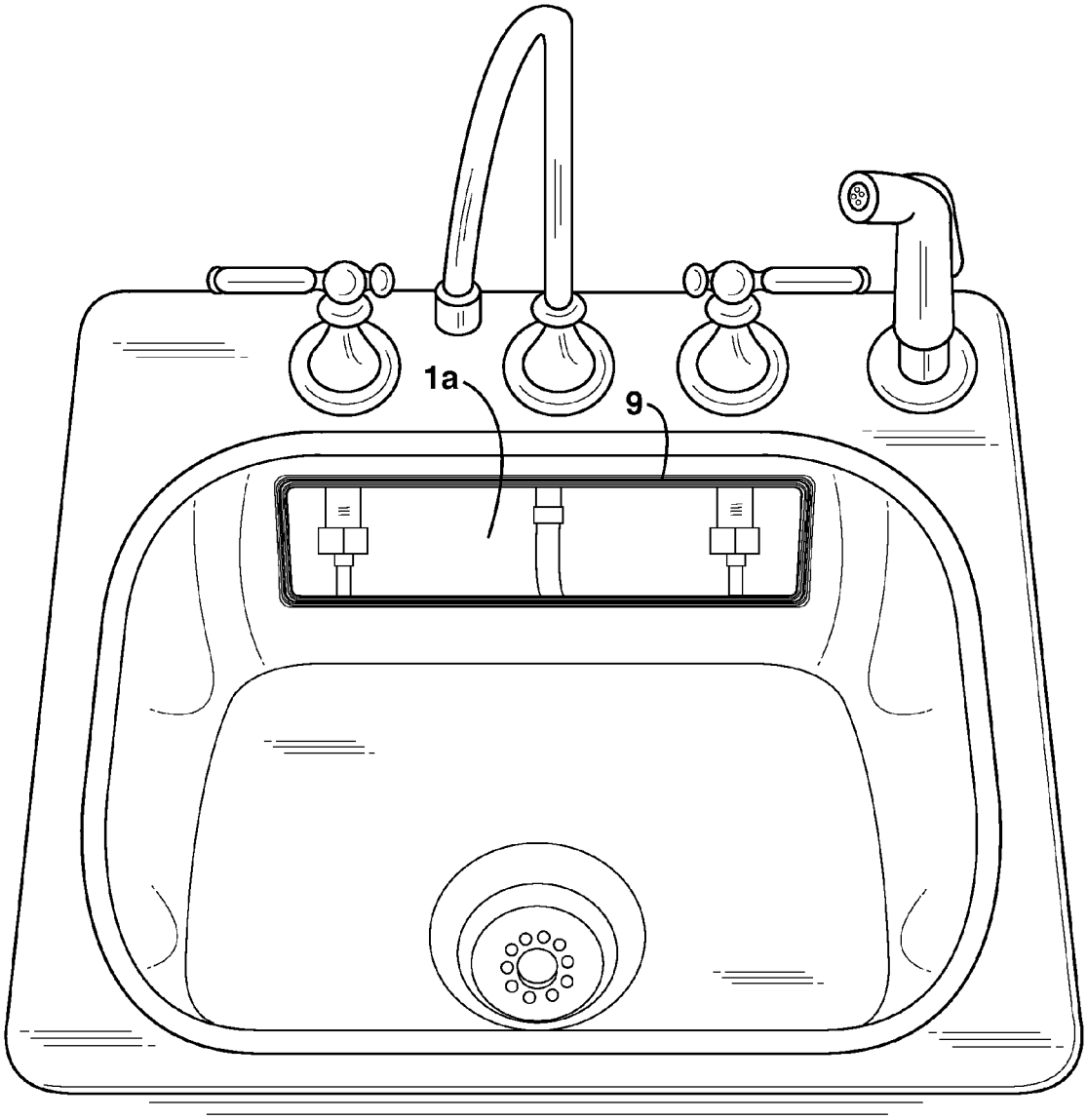
FIG. 10 shows the sink with the hole into which either of the detachable section variations as shown in FIGS. 9 and 9*a* would be secured.

Another embodiment using latches instead of screws and such latches not visible from the front of the sink is shown in FIGS. 6, 7, 8, 9, 9*a* and 10. FIG. 6 is a typical sink with faucets and a spray hose with the detachable segment 1 but with no screws. FIG. 7 shows the back of that sink with the detachable segment 1*b* with no screws but secured to the sink body with latches attached to the sink body and hooks on the detachable segment. FIG. 8 shows the same view as in FIG. 2 but with the latches attached to the detachable segment and the hooks on the sink body. FIGS. 9 and 9*a* show the two variations of the detachable sink segment 1*b*, one with hooks and the other with the latches corresponding to the sinks in FIGS. 7 and 8 respectively. FIG. 10 shows the front of that sink with the hole 1*a* and the recessed indentation on the sink body with its washer but without any screw receptacles and into which either detachable segment as shown in FIG. 9 or 9*a* would be inserted.

Other Embodiments

Other embodiments would be apparent to a person skilled in the art and would include: 1) variations in the size, shape and contours of the removable section of the sink to accommodate different size sinks and the number and location of the pre-drilled faucet and attachment openings; 2) variations in how the detachable section may be removed entirely or else could open on hinges; 3) variations in achieving a watertight fit of the movable section to the sink body; 4) variations in the manner of securing the removable section to the sink body.

CONCLUSION, RAMIFICATIONS, AND SCOPE

My concept of a detachable sink section can readily be seen to solve the problem of getting at the fittings and connections of the faucets and attachments located behind the sink in the enclosure of a cabinet and allowing repair or removal of them in a normal and comfortable manner. The embodiments shown above are examples of utilizing the concept of detachable section fixture segments, here of the sinks, but numerous variations for securing and shaping the section are possible and evident from the above within the spirit and scope of this concept. The scope of my novel solution should be determined by the appended claims and their legal equivalents, and not by the above examples.

The invention claimed is:

1. A sink, comprising:

a. a basin, and b. said basin containing a vertically aligned cutout in the body of said basin, and c. said cutout is located below an area of said sink where a faucet assembly is positioned, and d. said cutout is further located along a generally vertical wall of said basin and in front of an area of said sink behind which water supply lines make connection to said faucet assembly, and e. said cutout is of a dimension sufficient to expose said connections as well as any nuts and bolts fastening said faucet assembly to said sink, and f. said cutout is fully occupied by a detachable segment of the basin, and g. said detachable segment is attached to said basin by means of a seal between said detachable segment and said basin to prevent leakage, whereby allowing easy access to said connections, nuts, and bolts.

2. The sink of claim 1, wherein said detachable segment is fastened to said basin with screws securing said detachable segment to said basin.

3. The sink of claim 1, wherein said detachable segment is fastened to said basin with latched attached in back of said basin and which said latches are secured into receptacles in back of said detachable segment and which said receptacles are not visible from outside of said detachable segment.

* * * * *